United States Patent [19]

Gemma

[11] Patent Number: 4,934,012

[45] Date of Patent: Jun. 19, 1990

[54] DEVICE FOR BRUSHING THE GASKET FACE OF A MANHOLE FOR GAINING ACCESS TO THE INSIDE OF A VESSEL

[75] Inventor: Antoine Gemma, Meudon, France

[73] Assignee: Electricite de France, Paris, France

[21] Appl. No.: 348,279

[22] Filed: May 5, 1989

[30] Foreign Application Priority Data

May 10, 1988 [FR] France ..... 88 06276

[51] Int. Cl.[5] ..... A46B 13/02

[52] U.S. Cl. ..... 15/246.5; 15/21 E; 15/354; 15/359

[58] Field of Search ..... 15/21 R, 21 E, 354, 15/359, 383, 246.5

[56] References Cited

U.S. PATENT DOCUMENTS

| | | | |
|---|---|---|---|
| 2,668,968 | 2/1954 | Dobrowolski | 15/28 |
| 2,915,766 | 12/1959 | Peterson | 15/21 |
| 3,922,748 | 12/1975 | Ritz | 15/246.5 |
| 4,485,517 | 12/1984 | Voigt | 15/21 R X |
| 4,598,436 | 7/1986 | Regnet et al. | 15/21 R |
| 4,600,444 | 7/1986 | Miner | 134/8 |
| 4,805,253 | 2/1989 | Hanser | 15/21 E X |

FOREIGN PATENT DOCUMENTS

| | | |
|---|---|---|
| 631992 | 12/1927 | France . |
| 2512358 | 3/1983 | France . |
| 2598944 | 11/1987 | France . |

*Primary Examiner*—Chris K. Moore

*Attorney, Agent, or Firm*—Blakely, Sokoloff, Taylor & Zafman

[57] ABSTRACT

The invention relates to a device for brushing the gasket face of a manhole for gaining access to the inside of a vessel. The invention comprises a main frame (100), a secondary frame (200) mounted to rotate relative to the main frame (100) about an axis (101) which is coaxial with the manhole, and a brushing mount (300) supported by the secondary frame (200) and capable of oscillating about a second axis (102) transversal to the axis (101). Motor means (105 and 205) separately rotate the secondary frame (200) and the brush (301), thereby enabling effective tangential brushing to be performed. The device also includes a continuous suction passage (500) passing through the inside of the secondary frame (200) and through the oscillating brushing mount (300), and opening out into the brushing zone. The invention is particularly applicable to brushing the gasket face of a manhole in a steam generator or pressurizer of a nuclear power station.

27 Claims, 5 Drawing Sheets

FIG.11a
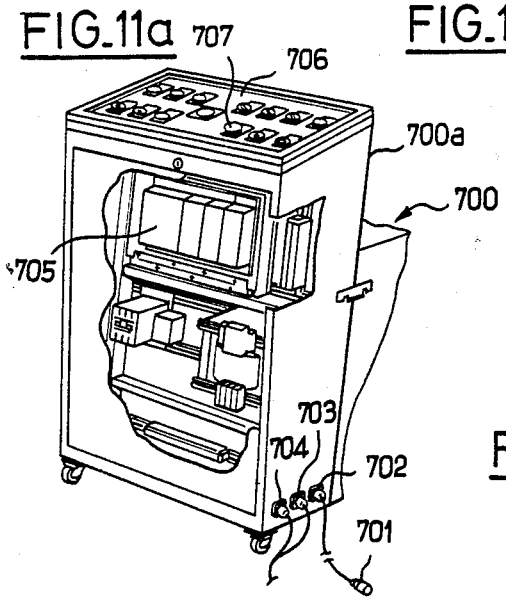
FIG.11b
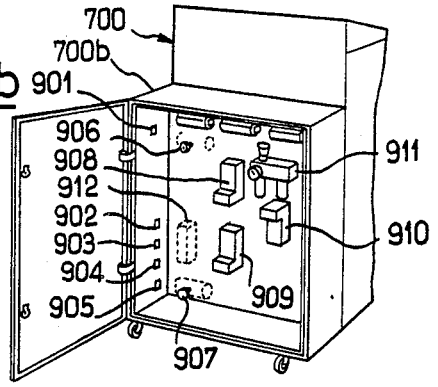
FIG.12
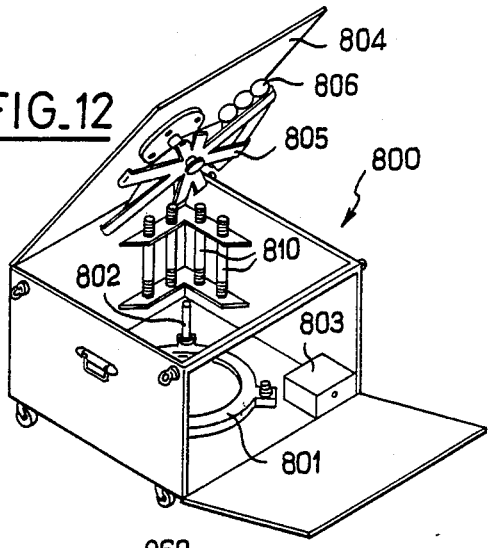
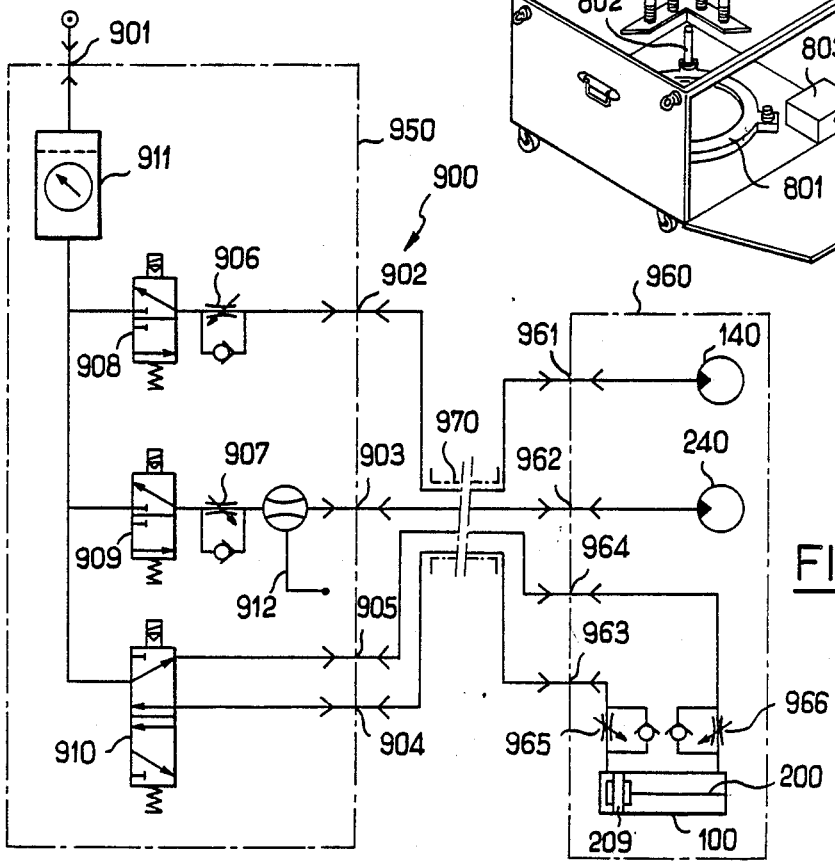
FIG.13

DEVICE FOR BRUSHING THE GASKET FACE OF A MANHOLE FOR GAINING ACCESS TO THE INSIDE OF A VESSEL

The present invention relates to brushing the gasket face of a manhole for gaining access to the inside of a vessel, particularly, but not exclusively, a steam generator or pressurizer in a nuclear power station.

BACKGROUND OF THE INVENTION

An access orifice such as an eyehole, an armhole, or a manhole (where these terms distinguish orifices of different sizes) has a gasket face, i.e. a face which negages a gasket when the orifice is closed by means of a cover or door. In use, this face needs to be cleaned so as to obtain a gasket face whose surface state is as close as possible to the mating face of the cover so as to avoid the gasket creeping on being compressed as the cover is clamped into position. The surface state naturally varies as a function of the type of gasket used, but a good match between the gasket face and the cover is essential for good performance of the gasket, in particular in applications presenting severe or aggressive conditions.

Several brushing devices have already been proposed, suitable for brushing gasket faces of various sizes.

A distinction needs to be made between end brushing techniques and tangential brushing techniques. In an end brushing device, the axis of the brush is perpendicular to the gasket face and the bristles of the brush are disposed end-on, i.e. they run parallel to the axis of the brush. In contrast, in a tangential brushing device, the axis of the brush runs parallel to the gasket face and the bristles of the brush radiate, i.e. they are disposed radially relative to the brush axis. In any event, it is necessary in both cases to set up relative displacement between the brush axis and the gasket face to be brushed and this displacement must be as uniform as possible in order to obtain high quality brushing.

Brushing machines providing end-on brushing have existed for a long time, in particular sanding machines and polishing machines. Reference can made, for example, to French patent number 631 992 which describes a machine for polishing, waxing, and brushing floors, or to U.S. Pat. No. 2 668 968 which describes a sanding machine having a plurality of rotary brushes which are driven simultaneously by means of an associated gear train.

However, these are hand-held machines which are not suitable for brushing a manhole for gaining access to the inside of a vessel, particularly in a nuclear power station. The gasket face must be brushed extremely carefully, and facing sealing surfaces must be cleaned in such a manner as to ensure that any possible deposit or encrustation is removed before the cover or door is put back into place to close the manhole. In addition, in such cases radioactive contamination limits the time a team can remain on site while brushing the gasket face. It is well known that people wearing protective clothing seek to stay for as short a time as possible in a zone which is radioactivity contaminated and this naturally does not encourage careful manual cleaning.

Brushing machines have therefore been proposed suitable for working automatically under highly satisfactory conditions with respect to the accuracy obtained. A typical example of such a machine is illustrated by French patent number 2 512 358 which describes a motor-driven apparatus mounted to slide in an axial direction (parallel to the axis of the manhole) and optionally in a radial direction prior to being locked in a cleaning position. The brush support then rotates over the gasket face and brush rotates simultaneously about is own axis.

Nevertheless, this apparatus suffers from numerous drawbacks.

The first drawback is inherent to the principle of end-on brushing, since this inevitably gives rise to cycloidal brushing lines which do not coincide with the traces of machining on the gasket face. This means that radial paths are marked which may generate cracking. Thus apparatuses of this type are not satisfactory for use with steam generators or pressurizers in nuclear power stations.

Another drawback lies in the fact that the equipment supporting the brush is not axially movable for displacing the brush parallel to the axis of the manhole. This means that brushing is initiated after the brush has previously been pressed against the gasket face to be brushed, thereby giving rise to a greater pressure force in the initial zone and as a result leaving traces of non-uniform brushing.

Another drawback lies in the drive method used. A belt drive is used for rotating the brush support. However, when working in a plane which is not horiziontal, and in particular when working in planes having a negative angle of inclination (working on a sloping undersurface of a vessel), this structure gives rise to an out-of-balance effect which makes it difficult to maintain uniform rotation of the brush support which means that brushing is not uniform, particularly since the out-of-balance effect is always the same at any one position on the gasket face.

Finally, machines of this type are difficult to put into place unless associated with a special positioning machine (as in FIG. 1 of French patent number 2 512 358) which is bulky and inconvenient. Self-contained positioning of the apparatus is done blind without axial or radial pre-centering taking place automatically. It is therefore necessary to perform a difficult initial centering operation so as to position the apparatus correctly before locking into place.

Machines for performing tangential brushing have also been proposed.

This principle is well known and has been used for a long time in lightweight apparatuses, e.g. for brushing the rims of car wheels (one such application is illustrated in U.S. Pat. No. 2 915 766).

Several attempts have been made to use this principle for brushing a gasket face, particularly on nuclear reactor vessels. Tangential brushing is the only way of obtaining circular brushing lines capable of coinciding with the machining marks, unlike end-on brushing, and this is immediately more satisfactory for this type of application.

Machines differ considerably depending on the size of the gasket face to be brushed.

A first type of tangential brushing machine has been proposed for very large diameters (e.g. 5 meters). A good illustration is to be found in U.S. Pat. No. 3 922 748. The machine described in this patent comprises a funnel-shaped support carrying a peripheral rack for driving the arm which carries the brush by means of an associated motor whose outlet shaft carries a gear wheel which meshes with said rack, the brush-carrying arm supporting the drive motor for the brush which is intended for cleaning two coaxial grooves, and which is pivotally mounted on the funnel-shaped support. Such a machine stays in place by gravity, given its great weight.

It will easily be understood that a machine of this type would be difficult to adapt to a manhole, a fortiori if the manhole lies in a plane which is not horizontal. In particular, cleaning a sloping underside of a vessel would require major clamping means for fixing the machine in place and would require the entire structure to be adapted so as to ensure that its rack drive would continue to work properly. Further, the brush-carrying arm is pressed against the surface to be brushed solely by its own weight, and no means are provided for adjusting the force with which it is pressed against the surface.

The above-mentioned machine can therefore be considered only for special types of application, of large dimensions and having surfaces to be brushed which are essentially horizontal, and in addition not requiring very accurate brushing.

Another type of tangential brushing machine has been proposed for small diameters, and this considerably improves the performance of the preceding machine, while having a structure which is much more compact and convenient for handling. A typical example of such a machine is described in French patent number 2 598 944.

This machine includes a hollow shaft mounted coaxially with the access orifice and housing a central shaft having two coaxial elements which are coupled by a flexible link. The central shaft drives the brush about its axis via an angle take-off by virtue of a single pneumatic motor which also drives the hollow shaft via an epicyclic gear train. The housing of the machine is assembled on a plate which is bolted to the vessel via a bayonet type mounting suitable for rapid fixing. The brush is traditionally capable of being raised or lowered against the gasket face to be brushed by means of a telescopic system constituting an actuator, and operating in on/off mode. In addition, when in the working position, a spring interposed between two telescopic elements serves to urge the brush against the gasket face.

Such a machine gives excellent results for orifices of small diameter, e.g. eyeholes (about 50 mm in diameter) or armholes (190 mm or 220 mm). However it is not well suited to larger diameters, in particular to manholes where the diameter is about 406 mm.

The telescopic structure including the angle take-off requires the brush to be highly excentric in position and this gives rise to large bending forces on the bearings. These forces necessarily give rise to unwanted play when the diameter of the orifice is large.

This machine also suffers from other drawbacks if the intended use is to brush the gasket face of a manhole.

Firstly, since all of the moving parts are driven by a single motor, the motor becomes heavy and bulky when high power is required, as turns out to be the case with such a structure for orifices having a diameter of more than 300 mm. In addition, the speed of rotation of the brush and of the support are necessarily at a set ratio to each other such that adjusting the ratio of these speeds necessarily requires gears to be changed and this constitutes a considerable drawback.

Further, sucking up (or blowing away) the debris is not made easy. A lateral opening is provided in the leading skirt in order to connect the chamber inside the skirt to a suction device. For large diameter orifices, the skirt delimits an enormous internal volume (for an orifice having a diameter of 406 mm, it is necessary to have a skirt with a diameter of about 600 mm) and this implies that the suction means must be very powerful in order to achieve a satisfactory result.

Further, the method of fixing on the bolted sole plate remains awkward in practice and is ill-adapted to the weight of a large machine. The process of installing the sole plate lengthens the time required for operations, and with vessels in nuclear power stations, this becomes incompatible with the dose rate around the gasket face.

Finally, the spring associated with the brush is not adjustable (and is difficult to make adjustable within the context of such a structure), yet it is also required to accommodate the play inherent to an out-of-balance system.

An object of the invention is to provide a brushing device enabling the gasket face of a manhole to be brushed uniformly and effectively by tangential type brushing, which device does not suffer from the drawbacks and limitations mentioned above for tangential brushing apparatuses.

Another object of the invention is to provide a brushing device which is simple in structure, fairly light, and suitable for being installed very quickly, even in a contaminated environment.

Another object of the invention is to provide a brushing device including various possible adjustments enabling the brushing process to be adapted as well as possible to operating conditions.

Another object of the invention is to provide a brushing device which is genuinely effective at sucking up (or blowing away) the debris due to cleaning, in particular when sucking up radioactive debris in a contaminated environment.

SUMMARY OF THE INVENTION

The present invention provides a device for brushing the gasket face of a manhole provided for gaining access to the inside of a vessel, the device comprising, in combination:

a main frame including means enabling the device to be fixed rapidly to the vessel;

a secondary frame which is generally L-shaped, said secondary frame being rotatably mounte on the main frame via a first branch of its L shape, with first motor means for rotating it about a first axis which is coaxial with the manhole when the device is fixed to the vessel, said secondary frame also supporting a brushing mount disposed at the end of the other branch of its L shape;

said brushing mount being capable of oscillating about a second axis which extends transversely relative to said first axis, and including a brush capable of rotating about a third axis parallel to said second axis, together with second motor means for rotating said brush about its axis;

resilient return means disposed between the secondary frame and the oscillating brushing mount, and tending to urge the brush against the gasket face to be brushed; and a continuous suction or blowing passage passing inside the secondary frame and the oscillating brushing mount to open out in the brushing zone.

Preferably, the secondary frame is driven by means of a worn screw and wheel system with the screw being connected to the first motor means: this method of providing drive is a considerable improvement over prior art cog belt systems since it prevents the brush support driving the motor under gravity when the gasket face is not horizontal.

It is advantageous for the brushing device to include counting means for counting the revolutions performed by the secondary frame, preferably by counting the revolutions performed by the worm screw of the drive system; in particular, the counting means may be essentially constituted by an excentric finger mounted at the end of the worm screw of the drive system and by a stationary sensor mounted on the main frame, said sensor being preferably an inductive detector.

Preferably, the first motor means are essentially constituted by a motor and stepdown gear box unit mounted on the main frame and including a pneumatic motor.

Advantageously, telescopic motion of the secondary frame relative to the main frame is achieved by a pneumatic system acting on portions of said frames constituting a piston and cylinder assembly. Preferably, an adjustable abutment is provided for limiting the compression stroke applied to the brush by virtue of telescopic sliding of the secondary frame; in particular, an adjustable abutment is provided for limiting the compression stroke applied to the brush by virtue of telescopic sliding of the secondary frame.

Advantageously, the oscillating brushing mount is mounted on a tubular sleeve constituting the end of the L-shaped secondary frame. Preferably, the tubular sleeve includes a circumferential groove in which a radial abutment disposed on the brushing mount is engaged in order to limit the angular range over which the said mount is free to oscillate, said range being preferably about 15°; in particular, the radial abutment may be a screw having a shoulder, said screw serving when tightened, to lock the brushing mount in position relative to the secondary frame.

Preferably, the tubular sleeve is hollow and constitutes a portion of the continuous suction or blowing passage.

Advantageously, the second motor means for rotating the brush about its axis, and said axis of rotation, are disposed on opposite sides of the tubular sleeve. Preferably, the secondary frame has a slightly set-back portion where the two branches of the L shape meet, thereby enabling the first axis about which said frame rotates and the third axis about which said brush rotates to intersect, and the second motor means are essentially constituted by a motor and stepdown gear box unit mounted on the secondary frame and including a pneumatic motor; in particular, the brush is rotated about its axis by a cog belt passing over a wheel mounted about said axis and over another wheel mounted on the outlet shaft of the associated motor and stepdown gear box unit.

Advantageously, the resilient return means tending to press the brush against the gasket face to be brushed are essentially constituted by a torsion spring passing around the tubular sleeve. Preferably, the torsion spring is connected to the secondary frame via a ring mounted coaxially on the tubular sleeve, with the angular position of said ring being adjustable in order to vary the force with which the brush is pressed against the gasket face to be brushed; in particular, the angular position of the ring is determined by a ratchet system mounted on the secondary frame.

It is also advantageous for the oscillating brushing mount to include a hood enveloping the brush, said hood defining a confined space in which the continuous suction or blowing passage opens out directly; in particular, the hood may carry sealing lips on either side of the brush.

Advantageously, the L-shaped secondary frame includes a central bore in each of its two branches, said bore forming at least a porton of the continuous suction or blowing passage; in particular, the continuous suction or blowing passage may open out to the rear of the secondary frame at an end orifice thereof, said orifice being disposed beyond the connection between the secondary frame and the main frame.

Advantageously, the main frame is essentially cross-shaped, having four radial branches each provided at its outer end with centering means and/or with rapid fixing means, together with an axial central branch which receives a portion of the secondary frame. Preferably, the main frame includes a peripheral handle serving, in particular, to facilitate installing the device on a manhole while remaining slightly to one side of the manhole axis; in particular, the main frame may include at least one peripheral stop member enabling a brushing process being performed automatically to be stopped immediately.

Finally, it is advantageous for the brushing device to include safety members preventing a brushing process taking place if the secondary frame is rotating at a speed below a predetermined threshold, e.g. one fourth of a revolution per minute, or if the brush is not rotating fast enough, e.g. if its speed of rotation is less than a threshold of about 100 revolutions per minute.

BRIEF DESCRIPTION OF THE DRAWINGS

An embodiment of the invention is described by way of example with reference to the accompanying drawings, in which:

FIGS. 11*a* and 11*b* are two diagrammatic views of a control box enabling the brushing device to be remotely controlled, with FIG. 11*a* relating to the electrical portion of the control box and FIG. 11*b* relating to its pneumatic portion;

FIG. 12 shows a packing case specifically designed for the brushing device, in particular to enable initial testing to be performed on the device; and FIG. 13 is a diagram of the pneumatic circuit for controlling the brushing device, including the associated safety and adjustment members.

DETAILED DESCRIPTION

Figure 1:
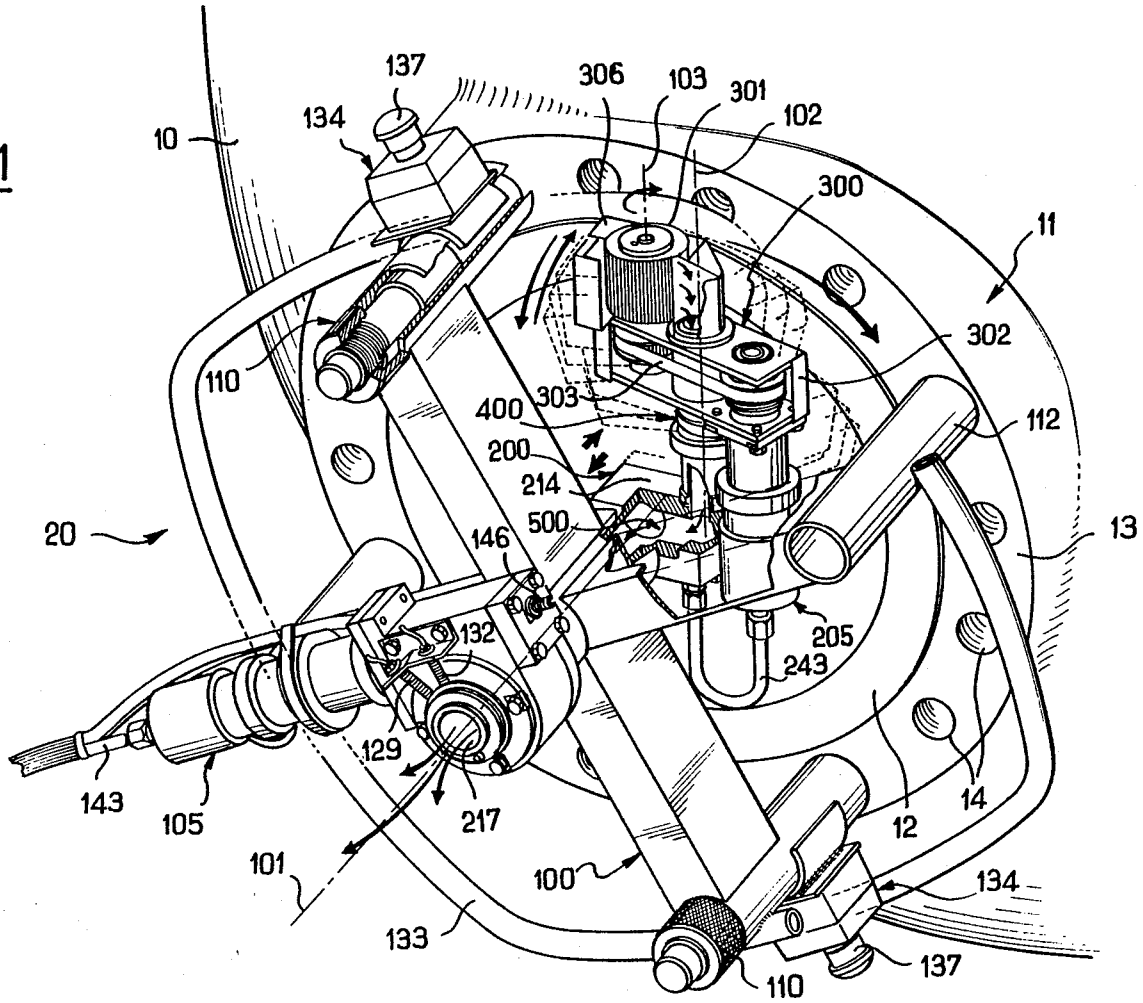
FIG. 1 is a perspective view of a brushing device of the invention in position in front of a secondary manhole in a steam generator of a nuclear power station, with the figure being partially cut-away in order to show up the structure of the secondary frame together with its central suction passage, and also the structure of the oscillating brushing mount.

FIG. 1 shows a manhole 11 near the bottom of a steam generator 10 for a nuclear power station, with the cover or door of the manhole being removed, and having a gasket face 12 in the form of a circular ring which is to be cleaned by means of a brushing device 20 of the invention. It should be observed that the manhole 11 may be relatively large in diameter, e.g. about 406 mm in diameter, and that the gasket face 12 is located, in this case, in a sloping plane with a negative angle of slope which may be about 45°. As explained above, prior art brushing machines cannot be adapted to such conditions or can only be adapted thereto with great difficulty. The gasket face 12 is surrounded by a circular flange 13 including a plurality of tapped holes 14 for receiving the ends of fixing bolts (not shown) associated with the manhole cover or door. As explained below, the brushing device of the invention can be put into place easily in front of the manhole orifice by being put into place and fixed quickly on bolts, either on additional bolts or on bolts left in place, given that it is common practice to leave all sixteen bolts in place after the cover has been removed. It should be observed that prior art brushing machines necessarily require all of the cover fixing bolts to be removed.

FIG. 1 shows the main members of the brushing device of the invention, which members are naturally described in greater detail with reference to FIGS. 2 to 10. The brushing device 20 is thus basically constituted by a combination of a main frame 100 including means for fixing the device rapidly to the vessel 10, a secondary frame 200 which is generally L-shaped, said secondary frame being movably mounted via a first branch of its L-shape to the main frame 100, and being capable of rotating be means of associated motor means about a first axis 101 which is coaxial with the manhole 11 when the brushing device 20 is fixed to the vessel 10. As explained below, the secondary frame 200 is mounted on the main frame 100 so as to be able to slide longitudinally along the first axis 101. The secondary frame 200 supports a brushing mount 300 disposed at the end of the other branch of the L-shape, said brushing mount being capable of oscillating about a second axis 102 extending transversely to the axis 101 (it should be observed that in this embodiment, the axes 101 and 102 do not intersect). The brushing mount 300 includes a brush 301 capable of rotating about a third axis 103 parallel to the second axis 102, together with second motor means for rotating the brush 301 about its axis. In FIG. 1, reference 105 designates the first motor means for rotating the secondary frame 200 relative to the main frame 100, and reference 205 designates the second motor means for rotating the brush 301 about its axis 103. The brushing device 20 also includes resilient return means 400 disposed between the secondary frame 200 and the oscillating brushing mount 300 and urging the brush 301 against the gasket face 12 to be brushed. The device also includes a continuous suction or blowing passage 500 passing inside the secondary frame 200 and inside the oscillating brushing mount 300, and opening out in the brushing zone.

FIG. 1 also includes arrows symbolizing the various motions that can take place: the rotary motion and also the translation motion in this case of the secondary frame 200 relative to the main frame 100 (about axis 101), the oscillating motion of the brushing mount 300 (about axis 102), and the rotary motion of the brush 301 (about axis 103). There is also a set of arrows symbolizing the suction of the brushing residue away from the brushing zone to a rear orifice 217 in the secondary frame 200, at a point where a suction duct is connected. It may already be observed that this provides a continuous suction (or blowing) passage passing through the secondary frame 200 and the oscillating brushing mount 300, thereby ensuring highly satisfactory evacuation of brushing debris, even in a contaminated atmosphere.

The essential members of the brushing device of the invention as mentioned briefly above are now described in greater detail with reference to FIGS. 2 to 9.

The main chassis 100 is essentially in the form of a cross in this case, having four radial branches 114 each provided at its outside end with centering means 112 and/or rapid fixing means 110, and having an axial central branch 115 receiving a portion of the secondary chassis 200. Thus, each of the ends of the four radial branches 114 of the main frame 100 has a sleeve 116 whose bottom edge 117 bears against the surface of the flange 13 of the manhole 11. The four sleeves 116 are large enough to pass the bolts 118 used for fixing the manhole cover. It is advantageous to provide centering means such as 112 at two opposite ends, together with rapid fixing means such as 110 at the other two opposite ends. For centering purposes, the sleeves 116 are simple smooth cylinders for passing over respective bolts, whereas for rapid fixing purposes the sleeves 116 are surmounted by captive nuts 119. These means 110 and 112 thus enable the brushing device to be pre-centered rapidly, particularly since this operation is not performed blind, unlike in certain prior art brushing machines. Once the brushing device has been put into place, the two nusts 119 are tightened, thereby fixing the device securely to the vessel.

Figure 2:
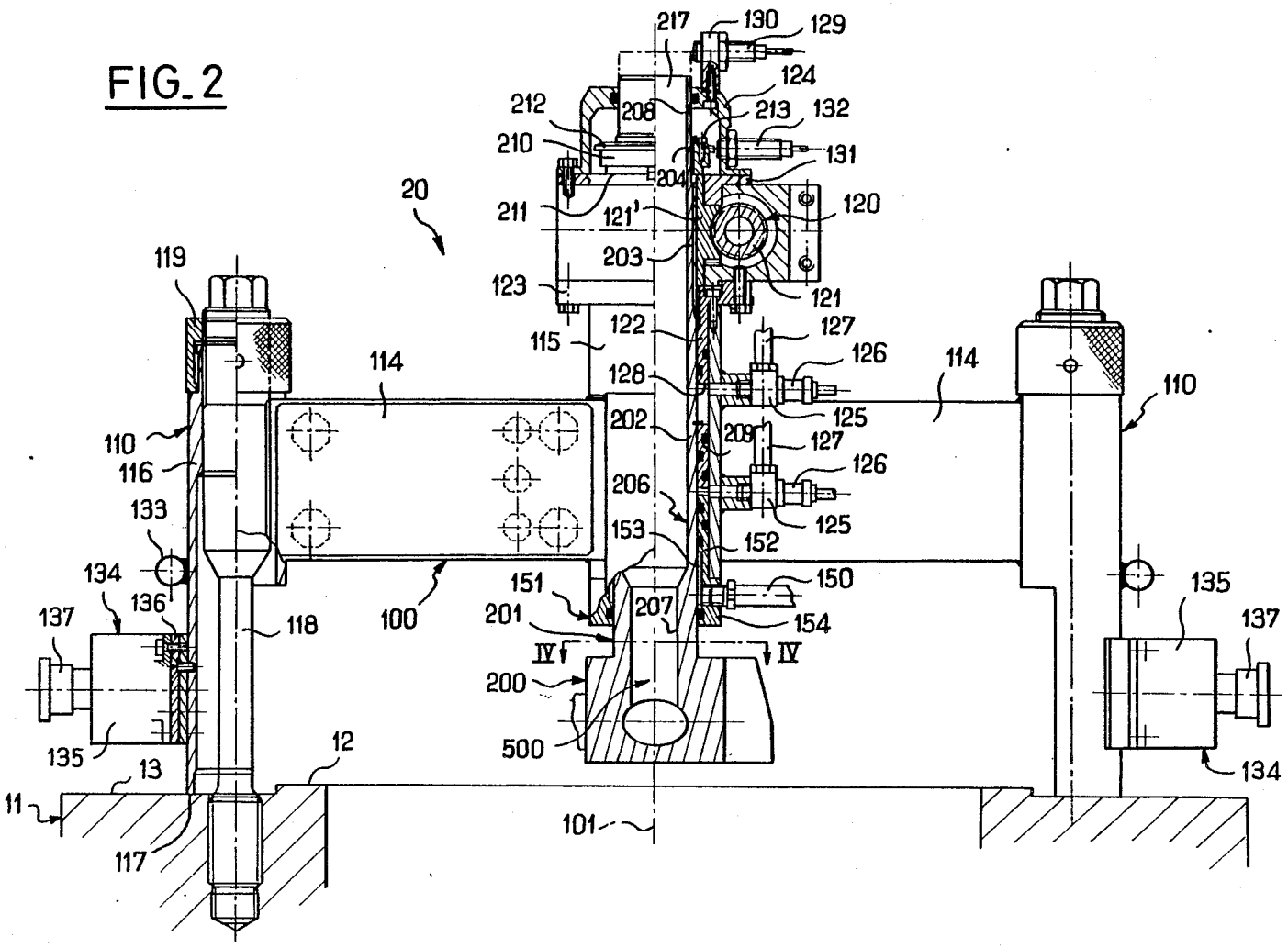
FIG. 2 is a fragmentary section through the FIG. 1 brushing device including the axis of the frames which coincides with the axis of the manhole whose gasket face is to be cleaned (with the section being taken on line II—II shown in FIG. 3)

A worm screw and wheel drive system 120 is provided for rotating the secondary frame 200 relative to the main frame 100. This system is mounted on the center branch 115 by means of a cylindrical portion 122 surmounted by a fixing flange 123. The secondary frame 200 is generally L-shaped, and it is movably mounted about a first axis 101 to the main frame 100 via a first branch of the L-shape, said axis 101 being coaxial with the manhole when the device is fixed to the vessel. As can be seen in FIG. 2, the central branch 201 of the secondary frame 200 is generally cylindrical in shape, with a portion 202 which is smooth externally and suitable for sliding in the cylindrical portion 122, a portion 203 which is fluted externally and which receives the wheel 121' which co-operates with the screw 121 of the worm screw and wheel drive system 120, then a portion 204 having an external thread on which an abutment ring 210 is screwed (whose function is described in greater detail below), and finally an externally smooth portion 208 capable of sliding in the central opening of a protective cap 124. Internally, the branch 201 has a cylindrical central bore 206 which is extended by a narrower cylindrical bore portion 207 in order to facilitate organizing the passage of the control fluid for the brush drive motor (as described in greater detail with reference to FIGS. 4 and 5).

The portion 202 of the secondary frame 200 also carries a piston element 209 whose longitudinal position is fixed by two spring clips, with said piston element sliding in sealed manner inside the bore in the central portion 115.

Two connector members 125 inlcuding a pressure limiter 126 and a flexible connector tube 127 are mounted on the central branch 115 of the main frame 100 in order to admit or exhaust air on either side of the piston element 209. It should be observed that the fluted coupling with the toothed wheel 121' does not prevent longitudinal sliding of the secondary frame 200. Thus, by means of appropriate pneumatic control, it is possible to choose the most appropriate longitudinal position for the secondary frame 200, thereby making it possible to adjust the distance between the axis of the brush and the gasket face to be brushed to a high degree of accuracy. The "upwards" sliding of the secondary frame 200 (i.e. away from the gasket face 12) is limited by the bottom edge 121 of the cylindrical portion 122, and this high position represented by dot-dashed lines in FIG. 2 is detected by a high position sensor 129 fixed on a plate 130 which is itself screwed to the cap 124. The cap 124 which is screwed on a spacing flange 131 which acts as an axial abutment for the toothed wheel 121' also carries an additional sensor 132 for detecting the low position of the secondary frame. However, low position abutment is organized in this case in a special way so as to provide a facility for adjustment: the internally threaded ring 210 acts as an axial abutment by means of its bottom edge 211, and its longtudinal position is maintained by a nut 212 clamped by means of a screw 213 engaging in a blind tapped hole in the ring 210. The periphery of the nut 212 also serves as a reference for the low position sensor 132. This fine adjustment facility in the axial direction is used, as explained below, for adjusting the degree to which a brush is compressed when particularly soft brushes are being used.

Figure 3:
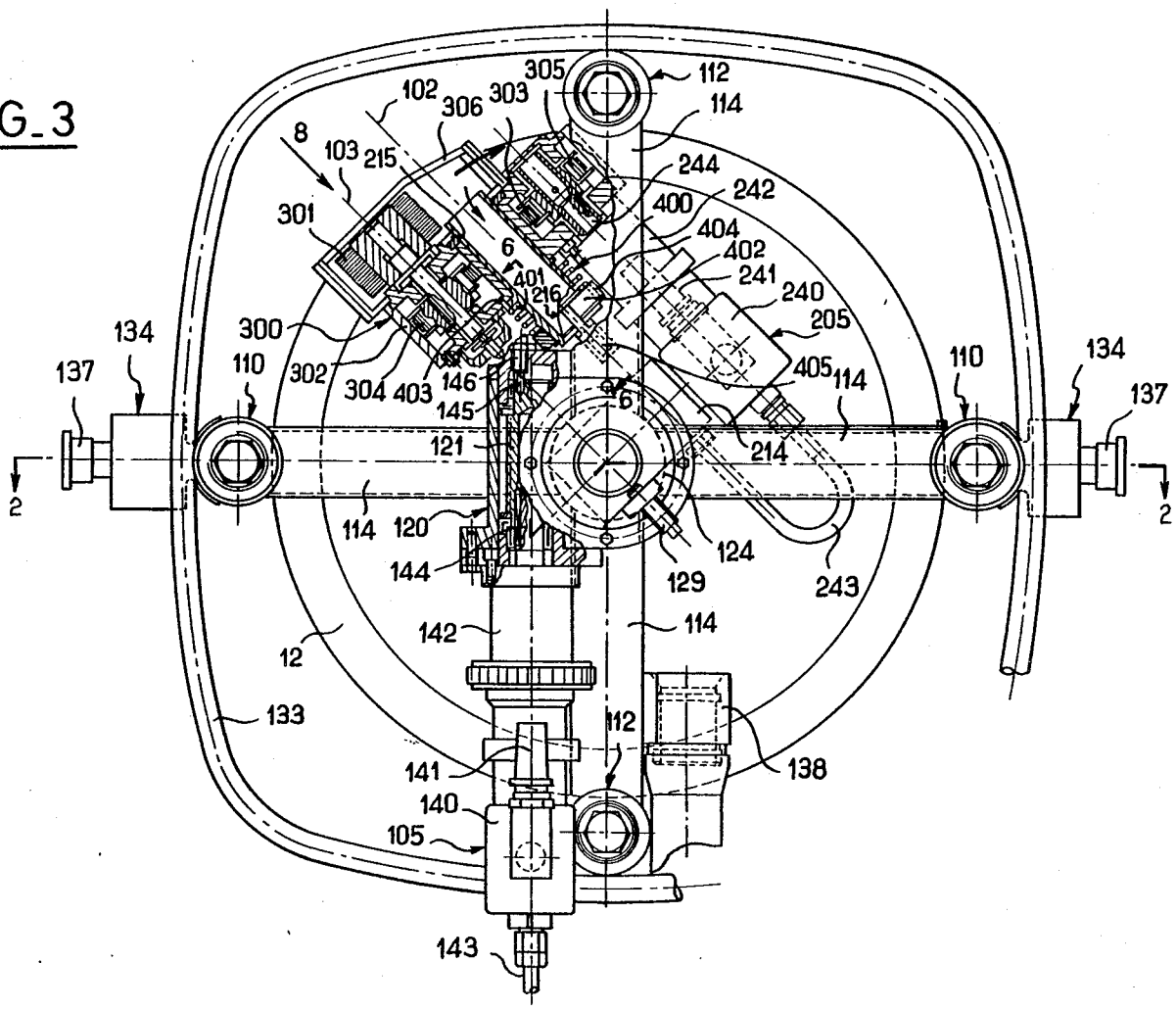
FIG. 3 is a plan view of the same brushing device, partially cut away to show up the structure of the oscillating brushing mount and the various motor means used for rotating the brush and its support.
Figure 4:
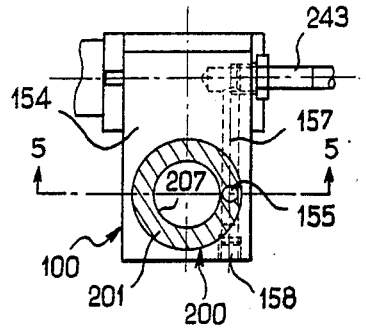
FIG. 4 is a fragmentary section on IV—IV of FIG. 2
Figure 5:
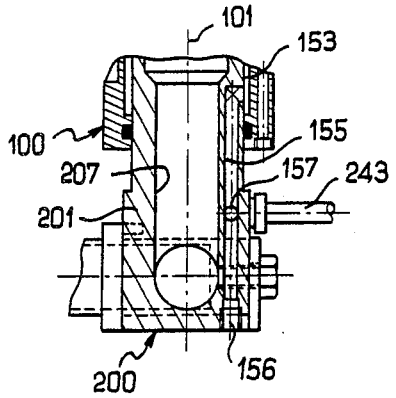
FIG. 5 is a fragmentary section on V—V of FIG. 4 showing the organization of the central suction passage and of the pneumatic circuit associated with the brush drive motor.
Figure 6:
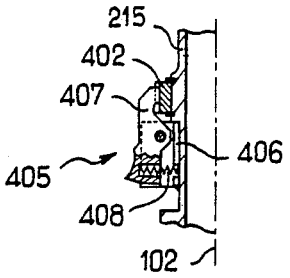
FIG. 6 is a fragmentary section on VI—VI of FIG. 3 for showing the adjustment means associated with the torsion spring for urging the brush against the gasket face to be brushed.

As mentioned above, the screw 121 of the worm screw and wheel drive system is connected to the first motor means 105. FIG. 3 shows how these motor means are disposed, which means are essentially constituted by a motor and stepdown gear unit mounted on the main frame 100, comprising a pneumatic motor 140, a silencer 141, and a stepdown gear box 142. The motor is fed by a pneumatic duct 143 in entirely conventional manner. Naturally, it is advantageous to be able to count the turns made by the secondary frame 200 which supports the brushing mount. The counting means in this case are constituted by an excentric finger 145 mounted at the end of the worm screw 121 of the drive system, and by an associated sensor 146 mounted stationary on the main frame 100, said sensor being preferably an inductive detector. Thus, rotation of the screw 121 controlled by means of the outlet shaft 144 of the gear box generates accurate information concerning the rotation of the brush support about the axis 101. Thus, whether the brushing device is operating manually or automatically, the operator can easily cause the brush support to perform a predetermined number of turns.

The bottom of the L-shaped secondary frame has a second branch for supporting the oscillating brush mount 300. However, it is advantageous to provide for the secondary frame 200 to have a slightly setback portion 214 where the two branches meet so that the axis 101 about which said frame rotates and the axis 103 about which the brush 301 rotates intersect each other. This is advantageous for transmitting forces in spite of the double bend that it imparts to the central suction passage. The setback portion 214 is more clearly visible in FIG. 1 which also shows the double bend in the central suction passage 500.

The oscillating brushing mount 300 is mounted in this case on a tubular sleeve 215 constituting at least a portion of the second branch of the L-shaped frame 200. The tubular sleeve 215 is hollow so as to constitute a portion of the continuous suction passage 500.

The oscillating brushing mount 300 comprises a main housing 302 rotatably mounted on the tubular sleeve 215. In this case, the housing 302 supports drive motor means for rotating the brush 301. These motor means 205 for rotating the brush 301 about its axis 103, and said axis of rotation 103, are preferably disposed on opposite sides of the tubular sleeve 215, thereby obtaining a better distribution of masses and of forces. The motor means 205 are analogous to the above-described means 105 and comprise a pneumatic motor 240, a silencer 241, and a stepdown gear box 242. A pneumatic duct 243 feeds the pneumatic motor 240, which duct has its other end connected to the secondary frame 200 at a rotary coupling, as described below with reference to FIGS. 4 and 5. The brush 301 is rotated about its axis 103 by a cog belt 303 passing over a wheel 304 mounted about said axis 103 and over another wheel 305 mounted on the outlet shaft 244 of the associated motor and gear box unit.

The oscillating brushing mount 300 also includes a hood 306 enveloping the brush 301, said hool defining a confined space into which the continuous suction passage opens out directly, i.e. in this case, the cylindrical space 216 inside the tubular sleeve 215. Thus, the continuous suction passage 500 passes via the inside of the secondary frame assembly 200 and finally opens out at the rear of said frame at an end orifice 217 thereof which is disposed beyond its connection with the main frame 100.

Figure 7:
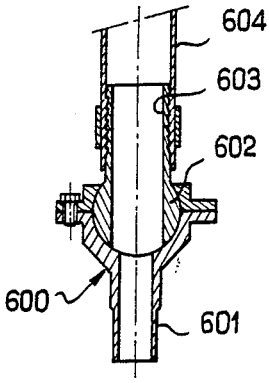
FIG. 7 is a section through the ball-and-socket type suction coupling which can be put into place instantaneously at the rear central orifice of the secondary frame.

FIG. 7 shows a ball-and-socket suction connection which can be put into place instantaneously at said orifice 217. This connection 600 includes an endpiece 601 fitted to the orifice 217, and having a spherical cavity suitable for receiving a bore 602 which is extended by a serrated portion 603 for connection to a suction duct 604. Naturally, when brushing in a contaminated environment, the brushed-up debris must necessarily be sucked up; however, in other applications in less dangerous environments, it may be possible to blow away the brushing debris, which is just as easily done by means of the same continuous passage 500.

A particularly advantageous embodiment for the resilient return means 400 disposed between the secondary frame 200 and the oscillating brushing mount 300 is shown urging the brush 301 against the gasket face to be brushed. These means are constituted by a torsion spring 401 passing round the tubular sleeve 215. It should be observed that such a torsion spring associated with an oscillating brushing mount is much more satisfactory than are prior art systems making use of a telescopic frame and a coaxial thrust spring. Should there be uneven surfaces in the gasket face to be brushed, the present mounting is much better and withstanding the resulting forces without substantially altering the force with which the bristles of the brush are applied against the gasket face by the torsion spring. This provides a system having genuine open loop mechanical servo-control of the brush position, which system is both sensitive and fast-acting.

It is also most advantageous to be able to vary the brush application force, particularly when using hard or semi-hard brushes, in which case brushing work must be capable of being performed at the limit between brushing and machining. This ensures optimum brushing effectiveness. In order to vary the force with which the brush 301 is pressed against the gasket face to be brushed, a link is provided in this case between the torsion spring 401 and the secondary frame 200 by means of a ring 402 mounted to rotate on the tubular sleeve 215, with the angular position of said ring being adjustable at will. FIG. 3 shows one end 403 of the spring 401 being received in an associated orifice in the housing 302, with the other end 404 being received in a blind hole in the adjustment ring 402. It will readily be understood that varying the angular position of this ring provides an easy manner of varying the force with which the brush 301 is pressed against the gasket face to be brushed. The angular position of the ring 402 may be determined and maintained by an appropriate means, e.g. using a ratchet system 405 mounted on the secondary frame 200, said system being more clearly visible in the detail of FIG. 6.

The ratchet system 405 includes a flange 406 mounted on the tubular sleeve 215, said flange supporting a pawl 407 which is subjected to the action of a return spring 408. The ring 402 has external teeth over at least a portion thereof, thereby constituting a ratchet wheel for co-operating with the end of the pawl 407. It is thus very easy to change the angular position of the ring 402.

Figure 8:
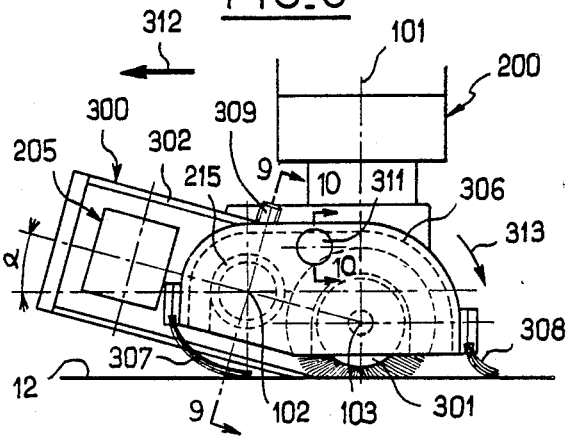
FIG. 8 is a fragmentary view on VII—VII of FIG. 3, relating to the oscillating brushing mount.
Figure 9:
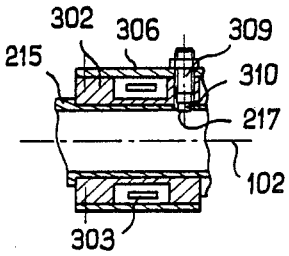
FIG. 9 is a section on IX—IX of FIG. 8 showing a radial abutment serving both to limit the angular range through which the oscillating brushing mount is free to move, and also optionally serving to lock said mount relative to the secondary frame.
Figure 10:
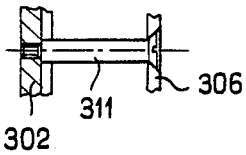
FIG. 10 is a section on X—X of FIG. 8 showing a spacer for holding a hood which envelopes the brush.

FIG. 8 is a fragmentary view along VIII of FIG. 3 and shows the structure of the brushing mount 300. This figure shows, in particular, two sealing lips 307 and 308 carried by the hood 306 and disposed on either side of the brush 301. These two lips partially confine the inside space of said hood, thereby preventing cleaning debris from becoming dispersed. The brushing mount 300 can oscillate about its axis 102, i.e. about the tubular sleeve 215 in this case. The angle through which the brushing mount 300 can rock is referenced in this case by an angle $\alpha$, and this angle may be about 15°. The detail of FIG. 9 shows up more clearly the radial abutment means which is advantageously provided for limiting the maximum angle through which the brushing mount 300 can oscillate. To this end, the tubular sleeve 215 includes a circumferential groove 217 (which naturally extends over a segment of the circumference of the angle $\alpha$, only), which groove receives the end 310 of a radial abutment 309. The radial abutment member 309 serves in this case to provide a second function if it is constituted by means of a screw having a shoulder: when the radial abutment is tightened it then locks the brushing mount 300 relative to the secondary frame 200, and this can be achieved in any predetermined angular position. The advantage of this feature is clarified below when discussing the nature of the brush used.

Arrows 312 and 313 in FIG. 8 corresponding respectively to the direction of rotation of the secondary frame 200 about the axis 101, and the direction of rotation of the brush 301 about its axis 103, serve to facilitate understanding of the process whereby the gasket face 12 is brushed.

Returning to the pneumatic feed to the motor means of the device, the means 105 for driving the secondary frame 200 relative to the main frame 100 can be fed without any difficulty, and the flexible duct 143 providing the feed has already been described. However, for the motor means 205 rotating the brush about its axis, account needs to be taken of the fact that the secondary frame 200 supporting the brush itself rotates about its own axis 101 coaxially with the gasket face to be brushed.

With reference to FIG. 2, there can be seen a connection hose 150 mounted near the bottom of the branch 115 of the main frame 100, and more precisely on a cylindrical end portion 151 provided for this purpose. This cylindrical portion includes a top part 152 for guiding the secondary frame by sliding telescopically, and defining an angular space 153 extending down to a bottom part 154 enabling the secondary frame 200 to slide in airtight manner relative to the end of the main frame. With reference to the sections of FIGS. 4 and 5, it can easily be seen that a passage 155 running longitudinally through the end of the second frame 200 is provided adjacent to the bore 207 of said frame. This passage communicates at one end with the above-mentioned annular space 153, and its other end is closed by a plug 156. This passage 155 also communicates with another passage 157 which is substantially orthogonal thereto. This other passage 157 communicates at one of its ends with the duct 243 for feeding the pneumatic motor of the motor means 205, and its other end is closed by a plug 158. Thus, air admitted via the duct 150 passes easily into the duct 243 on its way to the associated pneumatic motor 240, and this takes place for all possible angular positions of the secondary frame 200 relative to the main frame 100.

FIGS. 1 to 3 show additional equipment. Thus, the main frame 100 includes a peripheral handle 133 facilitating installation of the device while allowing operators to keep to one side of the manhole which constitutes a non-negligible advantage in a contaminated environment since the maximum dose is delivered axially.

The main frame 100 also includes at least one stop member 134 at its periphery, enabling a brushing process taking place under automatic control to be stopped immediately. Two stop members 134 are provided in this case, and their locations are best seen in FIG. 2. Each stop member 134 comprises a body 135 mounted on one of the sleeves 116 of the main frame by means of a spacer 136, and each includes an operating knob 137 which is placed so as to be easily accessible for punching in the event of danger. Advantageously, other safety members are also provided in order to prevent the brushing process taking place if the secondary frame 200 is rotating at a speed less than a predetermined value, e.g. one fourth of a revolution per minute (rpm), or if the brush 301 is not rotating fast enough, e.g. if it is rotating at a speed less than a threshold of about 100 rpm.

The brushing device of the invention is preferably remotely controllable from a separate control box, thereby enabling the device itself to be relatively light, e.g. having a weight of about 25 kg, thereby enabling it to be easily handled by only two people. FIGS. 11*a* and 11*b* show a control box 700 having an electro-pneumatic assembly for remotely controlling and remotely monitoring the brushing device. It is advantageous for the box 700 to comprise two portions 700*a* and 700*b*, with the portion 700*a* being a box containing electrical functions and the portion 700*b* being a box containing the pneumatic functions. These boxes are mounted on castors and they are provided with handles and hoist rings enabling them to be handled easily. The electrical box 700*a* is fed with 220 volts A.C. (phase+-neutral+ground) by means of a plug 701. The power cord is connected to the power-receiving connector 702 of the box which has two other connectors 703 and 704 for connection to the brushing device. A controller 705 controls and monitors the device as a whole. A control desk 706 protected by a plexiglass lid allows an operator to select the mode of operation (manual or automatic). It is advantageous to provide an emergency stop button as well, e.g. button 707, thereby enabling the brushing process to be stopped immediately from the control box. Under manual control, the two motors 140 and 240 can be under full manual control, but it is preferable for the brush 301 to be capable of being lowered only when both motors are rotating. In automatic operation, a selector serves to select the number of revolutions which it is desired that the secondary frame supporting the brush should perform, e.g. 1 to 4 complete revolutions. Monitoring is performed while the cycle takes place, and if either of the motors stops, then the machine must stop automatically.

The pneumatic box 700*b* contains pneumatic members for driving and controlling the motors. Some of these members are shown diagrammatically in FIG. 11*b*, but they are described in greater detail with reference to FIG. 13 which is a diagram of the pneumatic circuit 900 for controlling the brushing device, including the associated safety and adjustment members.

The various members used are well known to the person skilled in the art, so they may be described very briefly.

FIG. 11*b* shows fast-acting connectors 901 to 905, two flow rate limiters 906 and 907, three electrically controlled control valves 908 to 910, a pressure gauge and expander filter 911, and finally a flow rate meter 912 for monitoring brush rotation.

FIG. 13 shows the pneumatic circuit 900 for controlling the brushing device. Dot-dashed line 950 surrounds the members located in the box 700, and dot-dashed outline 960 surrounds the members associated with the brushing device per se. These two sets of equipment may be interconnected by means of a sheath 970 having a length which is preferably about 10 meters. Within outline 960, there is the motor 140 associated with rotating the secondary frame 200 which supports the brush, and the motor 240 associated with rotating the brush 301 about its axis. The telescopically slidable assembly is also shown diagrammatically as an actuator whose cylinder is constituted by the main frame 100 and whose piston rod is constituted by the secondary frame 200 with the piston itself being referenced 209. Rapid action connectors 961 to 964 are present on the brushing device, as are two flow rate limiters 965 and 966 associated with the actuator-forming assembly.

The motor 140 is thus controlled by valve 904 which in this case is a 3/2 type valve with a return spring. Flow rate limiter 906 serves to adjust the speed of rotation of the brush support, which speed should not be less than 0.5 rpm. More generally, its speed of rotation should preferably lie between 0.5 rpm and 1 rpm.

The motor 240 for rotating the brush about its axis is controlled by valve 909 which is likewise a 3/2 type valve with a return spring. The flow rate limiter 907 serves to adjust the speed rotation of the brush, which speed should nevertheless be sufficient to ensure that the air flow rate is greater than the trigger threshold of the flow rate monitor 912, thereby indirectly monitoring the speed of rotation of the brush. This trigger threshold is adjustable, e.g. over a range of 2.8 to 22.7 liters per minute. It is preferably factory set to a value corresponding to a brush speed of about 100 rpm. In practice, it is advantageous for the brush rotation speed to be selected in the range 100 rpm to 500 rpm.

The actuator-forming assembly for raising or lowering the brush is controlled by valve 910 which is of the 5/2 type having a return spring. The flow rate limiters 965 and 966 serve to set the speed at which the actuator assembly moves. The lockable rapid action connectors 902 to 905 enable the brushing device to be connected or disconnected from the control box, with rapid action connection 901 enabling the control box to be connected to a supply of compressed air. The air in the pneumatic circuit is filtered, cleaned, and lubricated by the pressure gauge expander filter 911.

The control assembly is preferably designed so that the brush-supporting secondary frame is prevented from lowering the brush if the brush is rotating at less than 100 rpm or if the secondary frame is rotating at less than 0.5 rpm, thereby avoiding damage to the gasket face to be brushed (with these numerical values being given purely by way of example). Further, in the event of an electrical power failure, the two motors 140 and 240 stop and the brush is raised automatically.

FIG. 12 shows a packing case 800 specially designed for the brushing device, and in particular providing means for initially testing the device. The case 800 is made of light alloy and serves for the purposes of handling, storing, and testing the brushing device. To this end it contains various items enabling said device to be operated. The case is preferably airtight so as to be suitable for receiving contaminated equipment. As can be seen in FIG. 12, the case 800 has a washer 801 on its bottom, which washer preferably reproduces the gasket face, and is associated with two fake bolts 802. This makes it possible both to fix the device in its case, and also to run the device in its packing case, thereby simulating the brushing of a gasket face. An auxiliary housing 803 is shown containing at least two brushes and some adjustment tools, and there are also several spare bolts 810 suitable for fixing the brushing device on a gasket face in the absence of the bolts for the manhole cover. Inside the lid 804 there is a star-shaped plate 805 for storing up to 15 meters of cable and pipe enabling the brushing device to be connected to a control box. When unwound, the cable and pipe can be connected to a connection junction 138 (referenced only in FIG. 3).

Various different types of brush may be used as a function of brushing conditions. Naturally, the hardness of the brushes will determine the pressure with which the brush is pressed against the gasket face for obtaining optimum cleaning.

When the gasket face is damaged, i.e. when micro-cracking or possible chemical attack has been observed, it is then preferable to use hard or semi-hard brushes. For example, when using bristles made of a relatively abrasive material such as that sold under the trademark TYNEX, excellent results can be obtained provided the speed of brush rotation is not less than 150 rpm and the speed of rotation of the brush supporting secondary frame is not less than 1 rpm. The operator must take care to avoid dangerously reducing the average roughness of the gasket face. For this type of brushing, the operator will normally need to measure the roughness frequently for safety purposes. The adjustable torsion spring can be used to set the compression force applied to the brush with great accuracy. The structure of the device of the invention is such that there is negligible variation in the compression force applied to the brush as a function of change in the angular position of the brush mount, and this makes it possible to set the force with which the brush is pressed against the gasket face to be brushed with accuracy.

If a soft brush is used, e.g. having 0.8 mm diameter nylon bristles, brushing has practically no effect on the average roughness of the gasket face. This type of brush is therefore used when the gasket face merely needs particles removing therefrom. In this case, it is preferable to select a high speed of brush rotation, e.g. 500 rpm, together with a low speed of rotation for the secondary frame, e.g. ½ rpm. The number of complete turns that the brush supporting frame needs to perform is determined as a function of particle adherence. When using soft brushes, the extent to which the brush is compressed can be adjusted merely by means of an adjustable abutment 210 (FIG. 2) with the brush mount being locked relative to the secondary frame by means of the shoulder screw 309. It should be observed that the position detectors 129 and 132 (FIG. 2) used as end-of-stroke members do not require adjusting in position in this case, in spite of the change in stroke due to displacement of the adjustable abutment 210.

Personnel safety is allowed for, in particular, by means of the emergency stop buttons 137 and 707, which buttons serve to switch off the three electrically controlled valves 908, 909, and 910 simultaneously, thereby stopping both motors 140 and 240, while simultaneously raising the brush support frame. In addition, the control and monitoring circuits are powered with 24 volts D.C. so there is no danger of electrocution. It should also be observed that operator time is limited to installing and removing the brushing device and its accessories, with the total time not exceeding five minutes, which is particularly favorable if the environment is radioactive.

In addition to the numerous advantages and adjustment facilities described above, two particularly important advantages of the device of the invention need underlining.

Firstly, cleaning debris can be sucked up in a particularly satisfactory manner in spite of the large diameter of the manhole whose gasket face is to be brushed. This is naturally of great importance in a contaminated environment. Finally, it should be observed that the brushing obtained is of very high quality, in particular because of the appropriately set uniform brush application pressure, and also by virtue of the brush support secondary frame being driven by a worm screw and wheel. This type of transmission is naturally much better than transmission provided by a cog belt, since it makes it possible to counter any out-of-balance forces effectively when the device is used out of the horizontal.

The invention is not limited to the embodiment described above, and on the contrary it covers any variant which reproduces the essential characteristics specified in the claims by equivalent means.

I claim:

1. A device for brushing the gasket face of a manhole provided for gaining access to the inside of a vessel, the device comprising, in combination:

a main frame including means enabling the device to be fixed rapidly to the vessel;

a secondary frame which is generally L-shaped, said secondary frame being rotatably mounted on the main frame via a first branch of its L shape, with first motor means for rotating it about a first axis which is coaxial with the manhole when the device is fixed to the vessel, said secondary frame also supporting a brushing mount disposed at the end of the other branch of its L shape;

said brushing mount being capable of oscillating about a second axis which extends transversely relative to said first axis, and including a brush capable of rotating about a third axis parallel to said second axis, together with second motor means for rotating said brush about its axis;

resilient return means disposed between the secondary frame and the oscillating brushing mount, and tending to urge the brush against the gasket face to be brushed; and a continuous suction or blowing passage passing inside the secondary frame and the oscillating brushing mount to open out in the brushing zone.

2. A brushing device according to claim 1, wherein the secondary frame is driven by means of a worm screw and wheel system with the screw being connected to the first motor means.

3. A brushing device according to claim 1, including counting means for counting the revolutions performed by the secondary frame, preferably by counting the revolutions performed by the worm screw of the drive system.

4. A brushing device according to claim 3, wherein the counting means are essentially constituted by an eccentric finger mounted at the end of the worm screw of the drive system and by a stationary sensor mounted on the main frame, said sensor being preferably an inductive detector.

5. A brushing device according to claim 1, wherein the first motor means are essentially constituted by a motor and stepdown gear box unit mouonted on the main frame and including a pneumatic motor.

6. A brushing device according to claim 1, wherein the secondary frame is mounted on the main frame by means allowing longitudinal sliding along the first axis.

7. A brushing device according to claim 6, wherein telescopic motion of the secondary frame relative to the main frame is achieved by a pneumatic system acting on portions of said frames constituting a piston and cylinder assembly.

8. A brushing device according to claim 6, wherein an adjustable abutment is provided for limiting the compression stroke applied to the brush by virtue of telescopic sliding of the secondary frame.

9. A brushing device according to claim 1, wherein the oscillating brushing mount is mounted on a tubular sleeve constituting the end of the L-shaped secondary frame.

10. A brushing device according to claim 9, wherein the tubular sleeve includes a circumferential groove in which a radial abutment disposed on the brushing mount is engaged in order to limit the angular range over which the said mount is free to oscillate, said range being preferably about 15°.

11. A brushing device according to claim 10, wherein the radial abutment is a screw having a shoulder, said screw serving, when tightened, to lock the brushing mount in position relative to the secondary frame.

12. A brushing device according to claim 9, wherein the tubular sleeve is hollow and constitutes a portion of the continuous suction or blowing passage.

13. A brushing device according to claim 9, wherein the second motor means for rotating the brush about its axis, and said axis of rotation, are disposed on opposite sides of the tubular sleeve.

14. A brushing device according to claim 13, wherein the secondary frame has a slightly set-back portion where the two branches of the L shape meet, thereby enabling the first axis about which said frame rotates and the third axis about which said brush rotates to intersect.

15. A brushing device according to claim 13, wherein the second motor means are essentially constituted by a motor and stepdown gear box unit mounted on the secondary frame and including a pnuematic motor.

16. A brushing device according to claim 15, wherein the brush is rotated about its axis by a cog belt passing over a wheel mounted about said axis and over another wheel mounted on the outlet shaft of the associated motor and stepdown gear box unit.

17. A brushing device according to claim 9, wherein the resilient return means tending to press the brush agianst the gasket face to be brushed are essentially constituted by a torsion spring passing around the tubular sleeve.

18. A brushing device according to claim 17, wherein the torsion spring is connected to the secondary frame via a ring mounted coaxially on the tubular sleeve, with the angular position of said ring being adjustable in order to vary the force with which the brush is pressed against the gasket face to be brushed.

19. A brushing device according to claim 18, wherein the angular position of the ring is determined by a ratchet system mounted on the secondary frame.

20. A brushing device according to claim 9, wherein the oscillating brushing mount includes a hood enveloping the brush, said hood defining a confined space in which the continuous suction or blowing passage opens out directly.

21. A brushing device according to claim 20, wherein the hood carries sealing lips on either side of the brush.

22. A brushing device according to claim 1, wherein the L-shaped secondary frame includes a central bore in each of its two branches, said bore forming at least a portion of the continuous suction or blowing passage.

23. A brushing device according to claim 22, wherein the continuous suction or blowing passage opens out to the rear of the secondary frame at an end orifice thereof, said orifice being disposed beyond the connection between the secondary frame and the main frame.

24. A brushing device according to claim 1, wherein the main frame is essentially cross-shaped, having four radial branches each provided at its outer end with centering means and/or with rapid fixing means, together with an axial central branch which receives a portion of the secondary frame.

25. A brushing device according to claim 24, wherein the main frame includes a peripheral handle serving, in particular, to facilitate installing the device on a manhole while remaining slightly to one side of the manhole axis.

26. A brushing device according to claim 24 or 25, wherein the main frame includes at least one peripheral stop member enabling a brushing process being performed automatically to be stopped immediately.

27. A brushing device according to claim 1, including safety members preventing a brushing process taking place if the secondary frame is rotating at a speed below a predetermined threshold, e.g. one fourth of a revolution per minute, or if the brush is not rotating fast enough, e.g. if its speed of rotation is less than a threshold of about 100 revolutions per minute.

* * * * *

UNITED STATES PATENT AND TRADEMARK OFFICE

CERTIFICATE OF CORRECTION

PATENT NO. : 4,934,012

DATED : 06/19/90

INVENTOR(S) : Gemma

It is certified that error appears in the above-identified patent and that said Letters Patent is hereby corrected as shown below:

| | | |
|---|---|---|
| col. 02, line 05 | after "and" | insert --the-- |
| col. 02, line 27 | delete "horiziontal" | insert --horizontal-- |
| col. 04, line 45 | delete "mounte" | insert --mounted-- |
| col. 04, line 66 | delete "worn" | insert --worm-- |
| col. 06, line 07 | delete "porton" | insert --portion-- |
| col. 07, line 54 | delete "be" | insert --by-- |
| col. 08, line 52 | delete "nusts" | insert --nuts-- |
| col. 09, line 17 | delete "inlcuding" | insert --including-- |
| col. 09, line 42 | delete "longtudinal" | insert --longitudinal-- |
| col. 10, line 41 | delete "hool" | insert --hood-- |
| col. 13, line 65 | delete "904" | insert --908-- |
| col. 16, line 47 | delete "mouonted" | insert --mounted-- |

Signed and Sealed this

Twenty-second Day of June, 1993

*Attest:*

Michael K. Kirk

MICHAEL K. KIRK

*Attesting Officer*

*Acting Commissioner of Patents and Trademarks*